US010953667B2

(12) United States Patent
Bauer

(10) Patent No.: US 10,953,667 B2
(45) Date of Patent: Mar. 23, 2021

(54) METHOD FOR PRINTING A CURVED SURFACE, AND DEVICE FOR PRINTING THREE-DIMENSIONAL SURFACES

(71) Applicant: FPT Robotik GmbH & Co. KG, Amtzell (DE)

(72) Inventor: Jörg R. Bauer, Baienfurt (DE)

(73) Assignee: FPT ROBOTIK GMBH & CO. KG, Amtzell (DE)

( * ) Notice: Subject to any disclaimer, the term of this patent is extended or adjusted under 35 U.S.C. 154(b) by 0 days.

(21) Appl. No.: 16/625,026

(22) PCT Filed: Jun. 22, 2018

(86) PCT No.: PCT/EP2018/066835
§ 371 (c)(1),
(2) Date: Dec. 20, 2019

(87) PCT Pub. No.: WO2019/002153
PCT Pub. Date: Jan. 3, 2019

(65) Prior Publication Data

US 2020/0215834 A1 Jul. 9, 2020

(30) Foreign Application Priority Data

Jun. 26, 2017 (DE) ..... 10 2017 114 159.6
Jun. 27, 2017 (DE) ..... 10 2017 114 280.0

(51) Int. Cl.
*B41J 3/407* (2006.01)
*B41J 25/00* (2006.01)

(52) U.S. Cl.
CPC ..... *B41J 3/4073* (2013.01); *B41J 25/006* (2013.01)

(58) Field of Classification Search
CPC ..... B41J 25/006; B41J 3/4073
See application file for complete search history.

(56) References Cited

U.S. PATENT DOCUMENTS 7,001,016 B2 * 2/2006 Baxter ..... B41J 3/4073 347/101
7,357,959 B2 4/2008 Bauer
(Continued)

FOREIGN PATENT DOCUMENTS

CN 88102463 A 11/1988
CN 105383185 A 3/2016
(Continued)

OTHER PUBLICATIONS

Machine translation of EP-19990206, published on Nov. 2008.*
(Continued)

*Primary Examiner* — Huan H Tran
(74) *Attorney, Agent, or Firm* — J-Tek Law PLLC; Jeffrey D. Tekanic; Scott T. Wakeman

(57) ABSTRACT

In a printing method, such as inkjet printing, at least one layer, such as a decor, etc. is printed on a surface by actuating a subset of a total number of individually actuatable discharge openings defined in a discharge surface of a printhead to eject defined quantities of one or more liquids onto the surface. All of the discharge openings in the actuated subset are spaced from respective points of impingement of the liquids on the surface between minimum and maximum clearances (B, C) from the respective points of impingement. The minimum clearance (B) is a minimum flight distance that each of the defined liquid quantities respectively requires to transform from a liquid column ejected from the respective actuated discharge opening into a substantially spherical liquid droplet. The maximum clearance (C) exceeds the minimum clearance (B) by a predetermined distance (t).

19 Claims, 7 Drawing Sheets

(56) References Cited

U.S. PATENT DOCUMENTS

| | | | |
|---|---|---|---|
| 8,256,890 | B2 | 9/2012 | Bauer |
| 2001/0017085 | A1 | 8/2001 | Kubo et al. |
| 2009/0167817 | A1 | 7/2009 | Orr |
| 2010/0068481 | A1 | 3/2010 | Bauer |
| 2015/0138275 | A1 | 5/2015 | Noell |
| 2016/0052312 | A1 | 2/2016 | Pitz et al. |
| 2017/0252765 | A1 | 9/2017 | Medard et al. |
| 2017/0267002 | A1 | 9/2017 | Pitz et al. |
| 2018/0217690 | A1 | 8/2018 | Bauer |

FOREIGN PATENT DOCUMENTS

| | | | | |
|---|---|---|---|---|
| CN | 106585121 | A | 4/2017 | |
| CN | 106739542 | A | 5/2017 | |
| DE | 102007021767 | A1 | 11/2008 | |
| DE | 102010004496 | A1 | 7/2011 | |
| DE | 102011086015 | A1 | 5/2013 | |
| DE | 102014221103 | A1 | 12/2014 | |
| EP | 0293089 | A2 | 11/1988 | |
| EP | 1990206 | A2 * | 11/2008 | ..... B41J 3/4073 |

OTHER PUBLICATIONS

English translation of the International Search Report dated Jan. 3, 2019 for parent application No. PCT/EP2018/066835.

English translation of the Written Opinion of the International Searching Authority for parent application No. PCT/EP2018/066835.

Office Action and Search Report from the Chinese Patent Office in related application No. CN 201880043034 dated Oct. 29, 2020, and machine translation of the Office Action.

* cited by examiner

METHOD FOR PRINTING A CURVED SURFACE, AND DEVICE FOR PRINTING THREE-DIMENSIONAL SURFACES

CROSS-REFERENCE

This application is the U.S. national stage of International Appl. No. PCT/EP2018/066835 filed on Jun. 22, 2018, which claims priority to German patent application no. 2017 114 159.6 filed on Jun. 26, 2017 and to German patent application no. 10 2017 114 280.0 filed on Jun. 27, 2017.

TECHNICAL FIELD

The invention generally relates to a method for printing a surface using a digital printing method, wherein defined liquid quantities, which impinge on the curved surface, can be sprayed from a plurality of individual, actuatable outlet openings disposed on a discharge surface of a printhead. The invention further relates to a device for printing three-dimensional surfaces.

RELATED ART

DE 10 2007 021 767 A1 discloses a method for printing a component having two surface regions, which are inclined with respect to each other, using a digital printing method. The surface regions, which are inclined with respect to each other, merge along a curved transition region. In a first printing step, the first surface region and at least a portion of the transition region is printed while a printhead moves linearly relative to the component. In a second printing step, after pivoting the component about an angle corresponding to the inclination angle between the surface regions, the second surface region and at least a portion of the transition region is printed while the printhead moves relative to the component. One characteristic of this known method is that the total quantity of the printing liquid that reaches each surface unit of the transition region can be specifically controlled such that it corresponds to the quantity reaching the flat surface regions; however, due to the undefined printing conditions, the transition region can not be readily printed with fine patterns or lines that extend, for example, obliquely over the curved transition region from one surface region to the other surface region.

SUMMARY

One non-limiting object of the present teachings is to provide a method for printing a surface, with which, e.g., three-dimensionally curved surfaces can also be printed in a precisely predetermined manner using a digital printing method. Furthermore, another object of the present teachings is to disclose a device for carrying out such a printing method.

In a first aspect of the present disclosure, a method of printing a three-dimensionally curved surface involves the facts that the liquid quantities sprayed from the discharge openings of the printhead have sufficient time to form liquid droplets, and that the liquid droplets reach the to-be-printed surface before they change their straight-line flight path, whereby a well-defined printing of the surface can be achieved. By appropriately arranging the discharge surface relative to a convex or concave surface, an advantageous use of the available discharge openings is achieved when either such surface is printed.

In a second aspect of the present disclosure, an optimal width of a printing path is achieved.

In a third aspect of the present disclosure, the quantity of liquid that is dispensed is adapted to the inclination of the to-be-printed surface relative to the discharge surface of the printhead.

In a fourth aspect of the present disclosure, the liquid droplets impinge on the to-be-printed surface such that they do not move tangentially to the surface in a disadvantageous manner, which would lead to a deterioration of the printing quality.

In a fifth aspect of the present disclosure, a widest-possible printing path is possible for three-dimensionally curved surfaces.

In a sixth aspect of the present disclosure, a method is provided, in which the to-be-printed surface is printed with a plurality of mutually adjacent paths that directly border one another without a visible transition and without overlapping.

In a seventh aspect of the present disclosure, a method is provided, in which the to-be-printed surface is printed with a plurality of mutually adjacent paths that are disposed adjacent to one another with mutual overlapping and without a visible transition.

In eighth to tenth aspects of the present disclosure, additional implementation modes of the method are provided that facilitate printing, with an excellent printing quality, of large, uneven surfaces.

In an eleventh aspect of the present disclosure, the basic design of a device for carrying out the present methods is provided.

In a twelfth aspect of the present disclosure, an advantageous embodiment of the drive devices for the mounts contained in the device is provided.

In a thirteenth aspect of the present disclosure, an advantageous further development of the present device is disclosed.

Using the features of Aspect 2 described at the end of the specification, it is achieved that, from among the discharge openings disposed on the discharge surface of the printhead, only those are activated for which the liquid quantities sprayed from them reach the surface as well-defined droplets.

Using the features of Aspects 3 and 4 described at the end of the specification, it is achieved that a printing path having the greatest possible width is achieved.

Before the invention is explained in an exemplary manner with reference to the schematic drawings and with further details, some general comments regarding digital printing methods are set forth first:

The inkjet method is preferably used as the printing method, in which predetermined liquid quantities are sprayed, in a manner digitally controlled by a computer system, from discharge openings or nozzles disposed in a discharge surface of a printhead. These liquid quantities are ejected from the discharge opening initially in the form of a liquid column. In the course of its flight, the liquid column transforms into a substantially spherical droplet before contacting the to-be-printed surface.

The discharge openings are usually disposed in a flat discharge surface of the printhead. One row of discharge openings can be provided. In the alternative, a plurality of rows can be provided such that the discharge openings of adjacent rows in the direction of relative movement between the printhead and the to-be-printed surface during a printing process are preferably offset from each other. In such an embodiment, a plurality of individual printheads, each having a row of discharge openings, can be assembled in a modular manner to form a larger printhead.

The printing width of a printhead (i.e. the maximum separation (spacing) between the discharge openings on opposite ends of a row in the direction perpendicular to the direction of relative movement between the printhead and a to-be-printed surface) usually is between 10 mm and 100 mm. The spraying of the liquid from the discharge openings is controlled by piezoelectric devices. The liquid droplets have different volumes depending on the geometry of the discharge opening and of the associated piezoelectric device. Customary volumes are between 3 pl and 160 pl. With a droplet size between 3 pl and 10 pl, high-quality decor printings can be produced in a quality level (resolution) between 600 and 1200 dpi.

To print a coating on a surface, droplet volumes greater than 80 pl may be used.

Printing liquids for white coatings or metallic coatings, or printing liquids having electrical conductivity, contain particles such that correspondingly larger discharge openings are advantageously used for such printing applications.

Very thin layers have, for example, a thickness of 1 μm; the thickness of coating layers is, for example, 8-20 μm.

Widely varying layers can be applied, in successive printing steps, onto a surface to be printed individually, one-atop-the other, or adjacent to one another, for example

- a decorative layer,
- a functional layer having conductive regions,
- uni-color layers or uni-coating layers, transparent or covering (non-transparent, e.g., opaque),
- adhesion-promotion layers, etc.

For a proper quality of the applied layers, it is important that the layers have, at least in sections, a constant thickness, and that when the layers are applied adjacent to one another in a plurality of paths, the paths merge into one another in a transitionless manner, i.e., striation free.

When printing a decor, it is advantageous to fix the sprayed-on droplets on the surface immediately by drying, for example, using UV light, so that the positional relationship of the droplets, which accounts for the quality of a good decor, is retained.

In contrast, when applying coatings or functional surfaces, it is advantageous if a drying process is activated only after the liquid droplets have connected (spread) into a homogeneous layer.

Furthermore, it is advantageous, in particular at high printing speeds, i.e., at a high speed of the relative movement between the printhead and the to-be-printed surface, if the printing openings or printing nozzles are inclined in the direction of the relative movement, in particular such that the droplets impinge approximately perpendicularly on the surface.

In the following, the invention is explained in an exemplary manner and with further details with reference to schematic drawings.

DETAILED DESCRIPTION OF THE INVENTION

Figure 1:
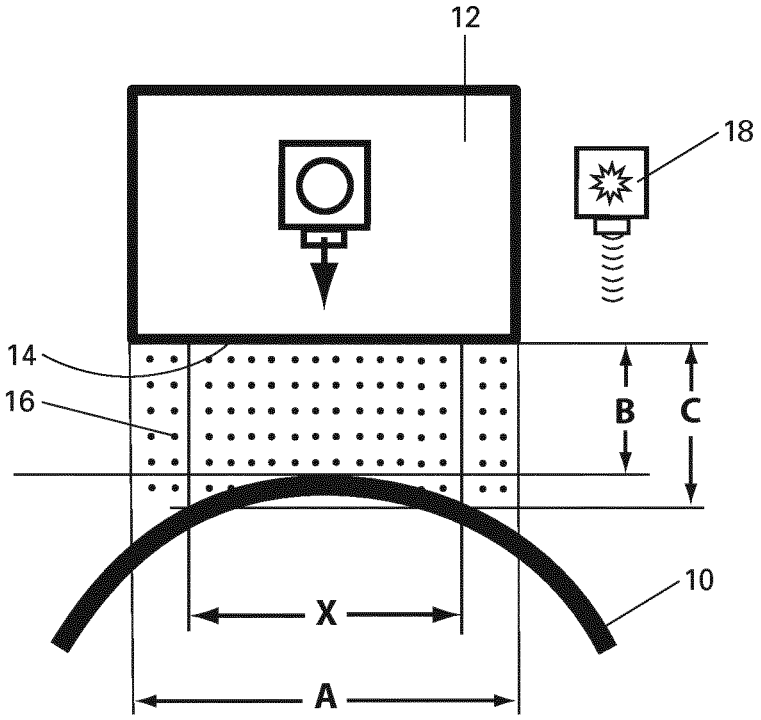
FIG. 1 shows a printhead with a convexly curved, to-be-printed surface disposed thereunder.

FIG. 1 shows a surface 10 of a component, for example, an interior decorative part of a motor vehicle, that is to be printed using a digital printing method. For this purpose, a printhead 12 having a flat discharge surface 14 is disposed over the surface 10. A plurality of discharge openings 16, which are schematically depicted in FIG. 1, are arranged in the discharge surface 14 in a known manner, as they are visible in a view toward the discharge surface 14 from below.

One characteristic of a digital printing method, such as an inkjet printing method, is that predetermined liquid quantities, for example, controlled by piezoelectric devices, are sprayable from the discharge openings 16, which are individually actuatable electronically in a known manner. These liquid quantities are ejected from the discharge openings 16 in the form of liquid columns having a diameter approximately equal to the diameter of the discharge openings 16, and transform during their flight into droplets that usually also undergo movement about their axes. In order for the printing of the surface to reliably take place in a defined manner, the individual liquid columns require a minimum flight distance B, within which they can transform into droplets. On the other hand, the flight distance must not be too long, so that the liquid droplets do not degenerate. The maximum permissible flight distance is designated as C.

For liquid droplets having a volume of 30 pl, the minimum required flight distance B is, for example, 0.5 mm. The maximum permissible flight distance C is 2 mm.

If the radius of curvature of the surface 10 has the value r (mm) and the difference between the maximum and minimum distances (C−B) is indicated by t (mm), then approximately the following value results based on the geometric relationships for the permissible printing width X (mm) when t is small in comparison to r:

$$X=2\times(t\times r)^{0.5}$$

As can be seen from FIG. 1, a central region of the discharge surface 14 is disposed parallel to a plane that is tangential to the surface 10, which is positioned underneath the discharge surface 14, and is spaced apart from that tangential plane by the clearance B. In accordance with the radius of curvature (r) of the surface 10, the maximum printing width X is then calculated according to the above-mentioned relationship (equation) so that the surface 10 will be printed with proper droplets in correspondence with the above-explained flight path criteria (i.e. the minimum distance B and the maximum distance C) during a relative movement between the surface 10 and the printhead 12 perpendicular to the drawing plane. As can be seen in FIG. 1, the total width A of the discharge openings 16 is wider than the maximum printing width X on the convex surface 10. The discharge openings 16 that lie outside the permissible printing width X are not actuated.

For a reliable determination of the clearance (spacing) between the discharge surface 14 and the to-be-printed surface 10, a clearance (distance) sensor 18, which is schematically depicted, is provided.

When the printing is performed by repeating a relative movement between the printhead 12 and the surface 10 along a plurality of superposed paths, the thickness of the (each) already-applied print layer can be taken into account by increasing the clearance (spacing) between the discharge surface 14 and the surface 10 by a corresponding amount (i.e. by the thickness of the already-applied print layer).

When the discharge openings 16 are actuated such that regions of the surface 10 are initially printed by discharge openings 16 disposed in a front row during the relative movement between the printhead 12 and the surface 10 and subsequently, in the same processing step, printing liquid is applied again onto an already-printed surface region from discharge openings disposed in a rear row, it is advantageous to slightly tilt the discharge surface 14 relative to the direction of the relative movement so that the clearance B of a subsequent row of discharge openings 16 from the then already-printed surface 10 is increased by the thickness of the already-applied layer.

Further aspects that can be considered when determining the discharge openings to be activated (actuated) and the volume of the liquid droplets to be sprayed are as follows:

As can be seen from FIG. 1, the ratio between the size of a region of the surface 10 to be printed and the size of the region of the discharge surface 14 associated therewith increases according to the inverse of the cosine of the angle between the surface region to be printed and the discharge surface 14. In order to achieve a uniform surface thickness of the printing, it is therefore advantageous when the volumes of the liquids sprayed from the corresponding regions of the discharge surface also increase according to the inverse of the cosine.

If the liquid droplets impinge obliquely on the to-be-printed surface, a "blurring" can develop. It is therefore advantageous to not print, in a particular printing step, surface regions that are inclined with respect to the discharge surface 14 by more than 6 degrees (for a decor printing) or 12 degrees (for a coating printing).

Figure 2:
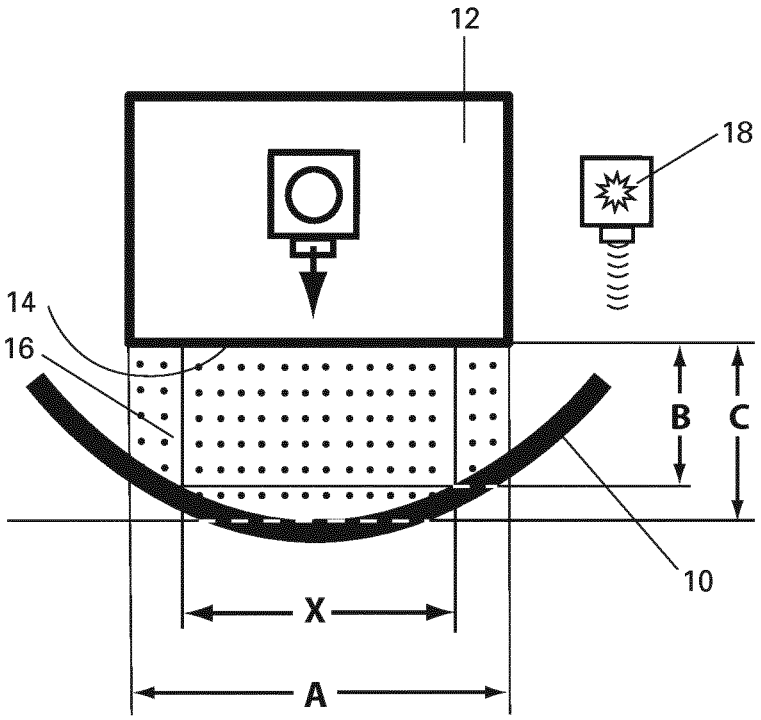
FIG. 2 shows a printhead with a concavely curved, to-be-printed surface disposed thereunder.

FIG. 2 shows a view similar to FIG. 1, but with a concavely curved surface 10. As can be seen, the width X of the region that is printable with a proper droplet quality is set (determined) such that the minimum flight distance B is set at the edges (end) of the region X, and the maximum flight distance C is set in the center of the region.

Further aspects of the present teachings are explained with reference to FIG. 3.

Figure 3:
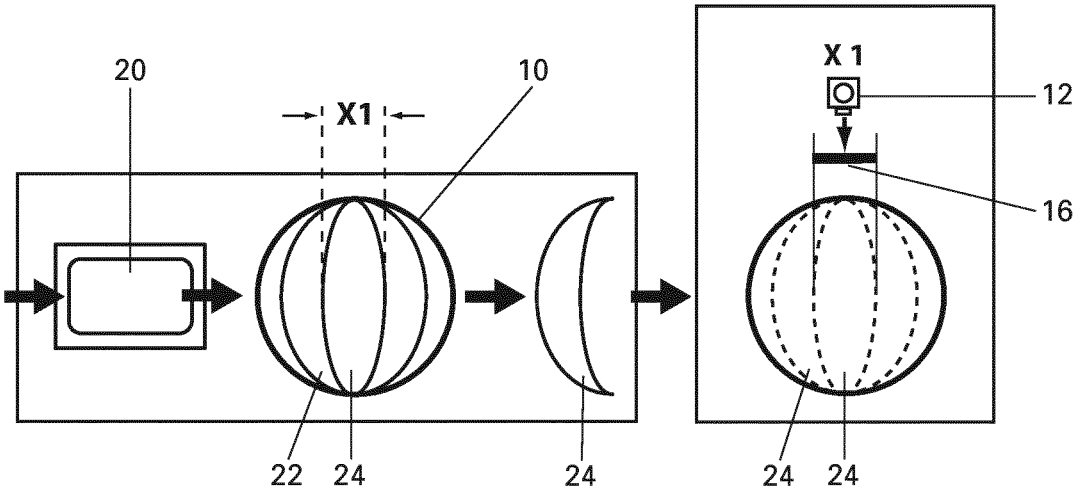
FIG. 3 shows drawings for explaining the printing of a sphere.

The surface data of an object to be printed, such as sphere 22 shown FIG. 3, are stored in a computer 20. The minimum and maximum flight distances of a droplet, as were explained with reference to FIG. 1, are calculated based on (i) the curvature of the to-be-printed surface 10 of the sphere 22, i.e., based on the radius of the sphere, (ii) data concerning the printhead 12, such as the diameter of the discharge openings, (iii) the volumes of the sprayed liquid quantities, (iv) the consistency of the printing liquid, etc. The maximum printing width X1, with which the surface of the sphere can be printed, is calculated based on the sphere diameter. The sphere surface is subdivided into individual segments 24 that each have the maximum permissible printing width X1 in an equatorial plane of the sphere. The printing of the sphere is then effected, for example, such that the printhead 12 is disposed at the predetermined clearance (spacing) B (FIG. 1) over the north pole of the sphere, and then the sphere is rotated by 360° about a horizontal axis (not drawn) extending in the drawing plane. In this case, two diametrically opposing segments 24 are printed. Furthermore the individual discharge openings 16 of the printhead 12 are actuated such that, starting from the poles of the sphere, the width of the printed segment increases up to the maximum width X1 and then decreases again. After printing the two diametrically opposing segments, the sphere or the printhead 12 is rotated about a vertical axis by an angle corresponding to the maximum width X1 of a segment, so that two further mutually opposing segments subsequently can be printed, etc.

Surfaces to be printed only rarely have a spherical-shaped or partial-spherical-shaped form. More common are surfaces that are cylindrically curved at least sectionally, or that are curved with different radii in mutually perpendicular directions.

Figure 4:
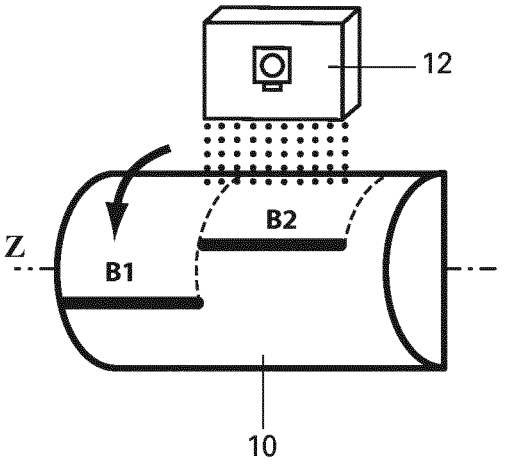
FIG. 4 shows a drawing for explaining the printing of a cylindrically curved surface.

The following modes of printing are advantageous for cylindrically curved surfaces:

As viewed in the direction of the cylinder axis Z (FIG. 4), when a permissible printing width X, which is determined according to FIG. 1, covers the entire region to be printed, it is advantageous to print the cylindrically curved surface in one step, in which a relative movement in the direction of the cylinder axis Z takes place between the surface and the printhead. If the permissible width is narrower than the width of the to-be-printed surface, then paths that lie next to each other can be printed in successive printing steps. Alternatively, it can be advantageous to lay the paths B1, B2, . . . BN such that they are directed in the circumferential direction of the cylindrical curvature, as depicted in FIG. 4.

The full width of the printhead 12 can then be used, since the to-be-printed surface is not curved perpendicular to the direction of the relative movement between the printhead and the surface.

Figure 5:
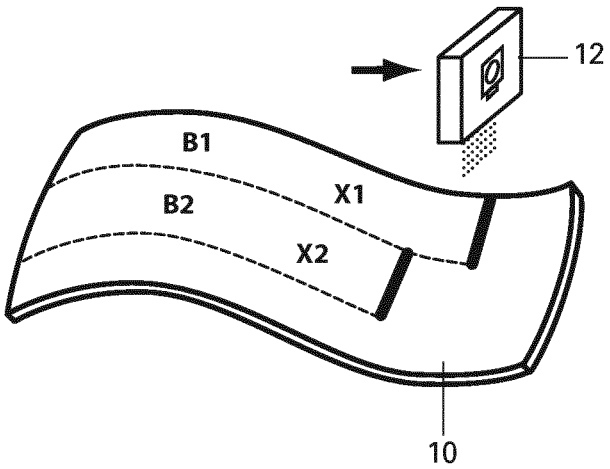
FIG. 5 shows a drawing for explaining the printing of a three-dimensionally curved surface.

When a surface having two axes of curvature that are perpendicular to each other and different radii of curvature is to be printed (FIG. 5), and this cannot be effected in a single path, to optimally use the width of the printhead 12 it is advantageous if the longitudinal direction of the paths B1, B2 is directed in the circumferential direction of the curvature having the smaller radius of curvature, and the paths B1, B2 are adjacent in the circumferential direction of the curvature having the larger radius of curvature. The surface 10 of FIG. 5 has a smaller curvature transversely to its longitudinal extension (from left to right in the Figure) than transversely to its longitudinal extension. It is understood that, due to the boundary conditions explained with reference to FIG. 1, the widths X1, X2 of the printing paths B1, B2 can be different when the curvature in the transverse direction of the surface changes. During the relative movement between the surface 10 and the printhead 12 during the printing, the clearance between the printhead 12 and the surface 10 is controlled such that the conditions of FIG. 1 are continuously met. The width X1, X2 of each path is advantageously constant along its entire length and is thereby given by the maximum curvature of the surface transversely to the longitudinal direction along the entire length of the path.

It will be explained with reference to FIG. 6 how convex and concave surfaces can be printed such that printed paths disposed next to one another, which merge in a transitionless manner, i.e., without visible transitions, can be formed in a so-called multi-pass method.

Figure 6:
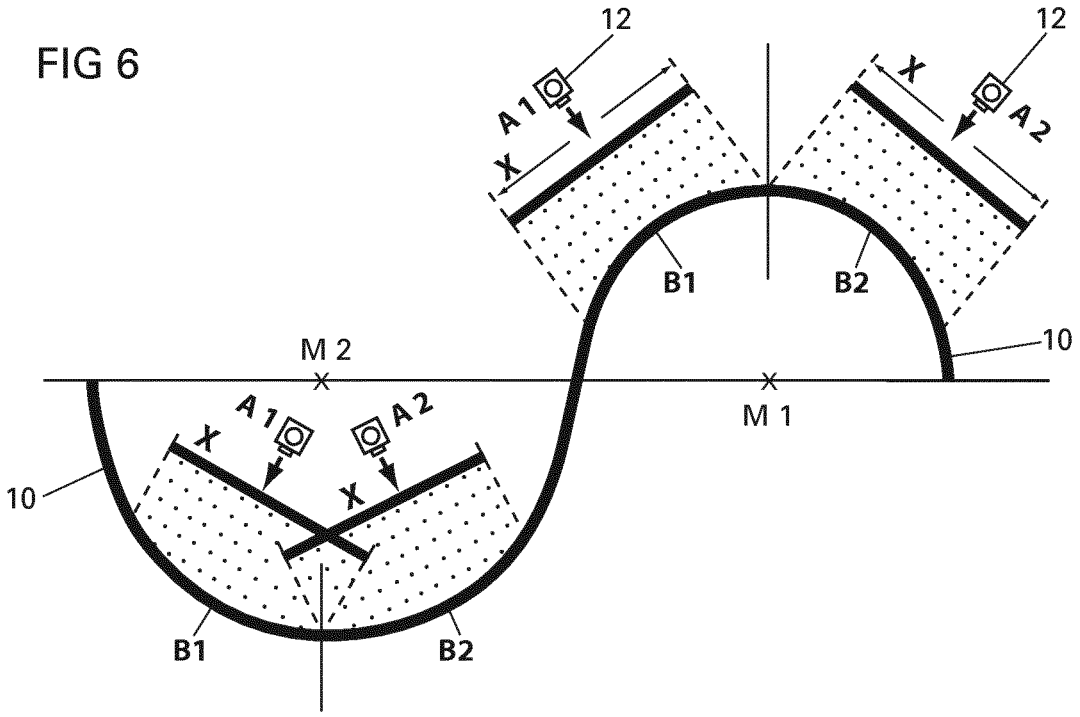
FIG. 6 shows views for explaining the printing of concavely or convexly curved surfaces having overlap-free bordering paths.

The right half of FIG. 6 shows a convexly curved surface region 10 having a curvature axis M1. A first path B1 is printed in a first printing step A1, in which a relative movement between the printhead 12 and the surface 10 takes place in the direction of the curvature axis M1. The effective printing width of the discharge surface 14 herein leads to a corresponding width X of the path B1. After formation (printing) of the path B1, a relative rotation between the printhead 12 and the surface 10 takes place about an angle such that the path B2, which is applied by the printhead 12 in a subsequent printing step A2, connects seamlessly to the path B1 without overlapping. The controlling of the relative rotation between the printhead 12 and the surface 10 between the two printing steps is so precise that the droplets reaching the surface 10 at the left edge of the path in accordance with FIG. 6 connect exactly to the droplets applied to the right edge of the path B1 according to FIG. 6 as if they were components of a common wide printing path. In this way, the two paths B1, B2 merge seamlessly into each other and a combined printed surface is created by the two paths B1 and B2 without a visible seam.

The left half of FIG. 6 shows the relationships for a concave surface 10 having a curvature axis M2. As can be seen, after applying a first path B1, a relative rotation between the printhead 12 and the surface 10 is also possible here such that the second path B2 can be applied alongside the first path directly connecting thereto, i.e., without a visible transition, without overlapping with the first path B1.

The method explained with reference to FIG. 6, in which adjacent paths adjoin one another in an overlap-free manner without a visible transition, is advantageously used when the rotational position between the printhead 12 and the to-be printed surface 10 is only changed slightly, for example, by an angle less than 6 degrees, advantageously 2-3 degrees (for a decor printing) or smaller than 12 degrees (when printing a coating, conductor paths, functional surfaces, etc.). The angle of incidence of the droplets on the printed surface, which droplets form the one edge of a printed path, then differs from the angle of incidence of the droplets forming the adjacent edge of the adjoining path only by a small angle of rotation, so that the printing of the adjacent edges takes place under essentially identical conditions and no change is visible.

The method of printing an adjacent path, after printing of one path, after a slight pivoting between the printhead and the surface, can in fact lead to narrower paths in the case of highly curved surfaces and thus to an increase of the paths; however, this is advantageous for the printing quality.

Figure 7:
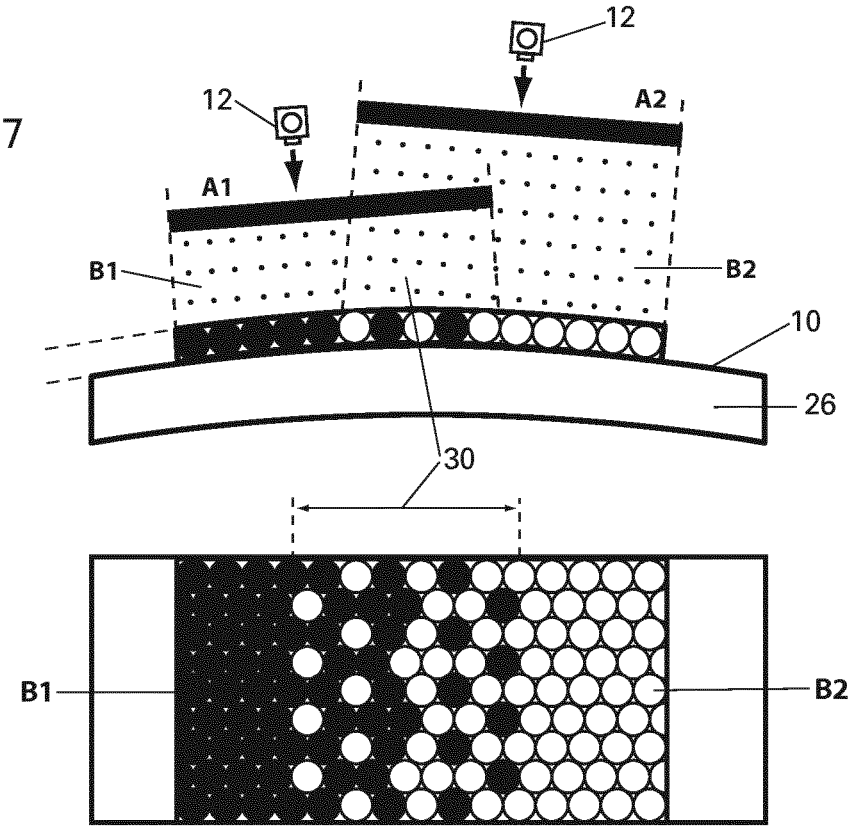
FIGS. 7 and 8 show views for explaining the printing of concavely or convexly curved surfaces having adjacently disposed paths that overlap.

FIG. 7 shows how, alternatively to the illustration of FIG. 6, two paths B1 and B2 can be applied adjacent to each other onto the surface 10 of a component 26 with mutual overlap. For this purpose, first, for the first printing step A1, the relative rotational position between the printhead 12 and the to-be-printed surface 10 during a first printing step A1, in which a first path B1 is applied, is set in an electronic data-processing system. Furthermore, the relative rotational position between the printhead 12 and the surface 10, which is to be taken in a second printing step A2, is set in the electronic data processing system in advance. For the sake of clarity, the position of the printhead 12 in the second printing step A2 in FIG. 7 is depicted as farther away from the surface 10 than in the first printing step A1. In fact, the clearance between the printhead 12 and the surface 10 is advantageously identical during the first and the second printing steps A1, A2. As can be seen from FIG. 7, there is an overlap region 30 between the two previously-set paths B1 and B2, within which the right edge of the path B1 overlaps the left edge of the path B2. Simply for the sake of clarity, the droplets applied in the second printing step A2 are not depicted in a blackened manner. In order that no difference is visible between the printing- or color-intensity of the adjacent paths B1, B2, the areal droplet density decreases from left to right in the overlap region 30 when applying the first path B1. The droplet density of the second printing path B2 accordingly increases from left to right in the overlap region 30 so that the same droplet density is present overall in the overlap region 30 as in the regions of the paths B1, B2 adjacent to the overlap region 30. It is understood that instead of the surface density, the volume of the droplets also changes.

Figure 8:
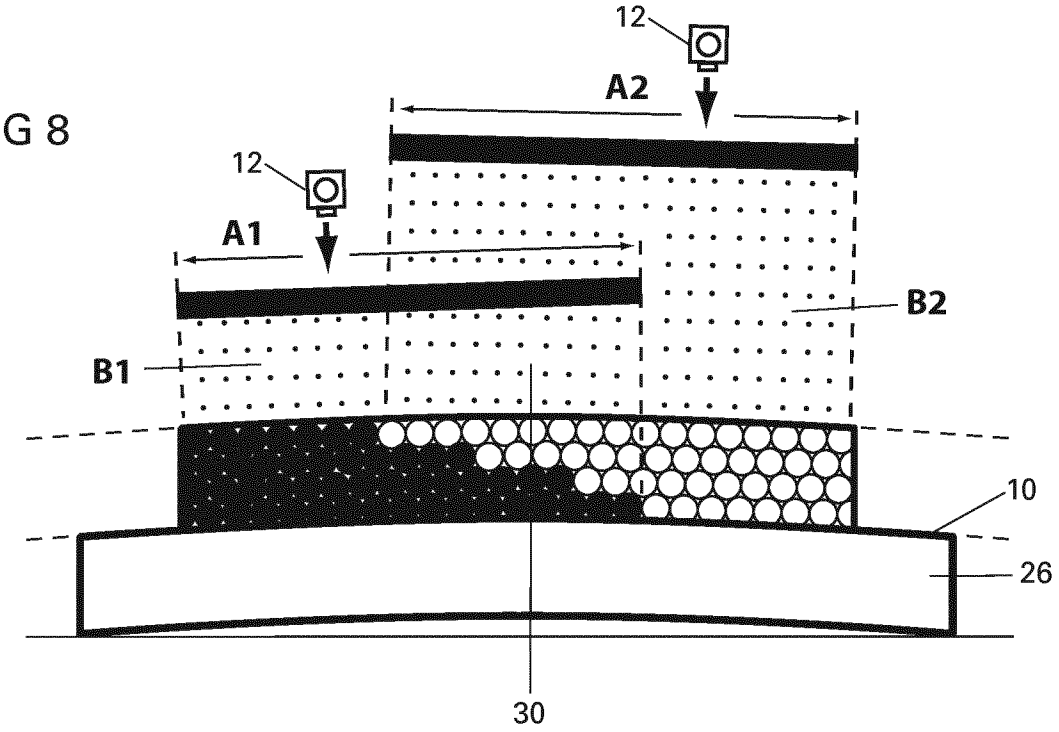

A layered build-up of the paths B1, B2 is depicted in FIG. 8, which can be achieved by applying the layers (4 layers in the depicted example) successively with a one-time linear relative movement between the printhead and the surface by rows of discharge openings that are disposed one-behind-the-other, or by applying each layer according to a single linear relative movement between the printhead and the surface. As can be seen, each of the layers disposed one-atop-the-other is built up differently in the overlap region 30. The regions of the left path B1 forming the overlap region 30 decrease from below to above, while the regions of the right path B2 forming the overlap region 30 increase from below to above.

For additional quality control, the printhead can be provided with sensor devices that sense the color intensity and/or the printing density of the already-applied layer or path prior to the application of a new layer or path, so that the surface density and/or the size of the droplets can be readjusted when there is a deviation between a target value and an actual value.

The method of applying adjacent paths with mutual overlapping that was delineated with reference to FIGS. 7 and 8, in particular the method according to FIG. 8, is particularly preferable, for example, when the paths of electric conductors, which are produced by electrically conductive liquid droplets being sprayed-on, are crossed. The electrical conductors then lead from one path into an adjacent path in a transitionless manner without any disturbance (cross-section change).

Figure 9:
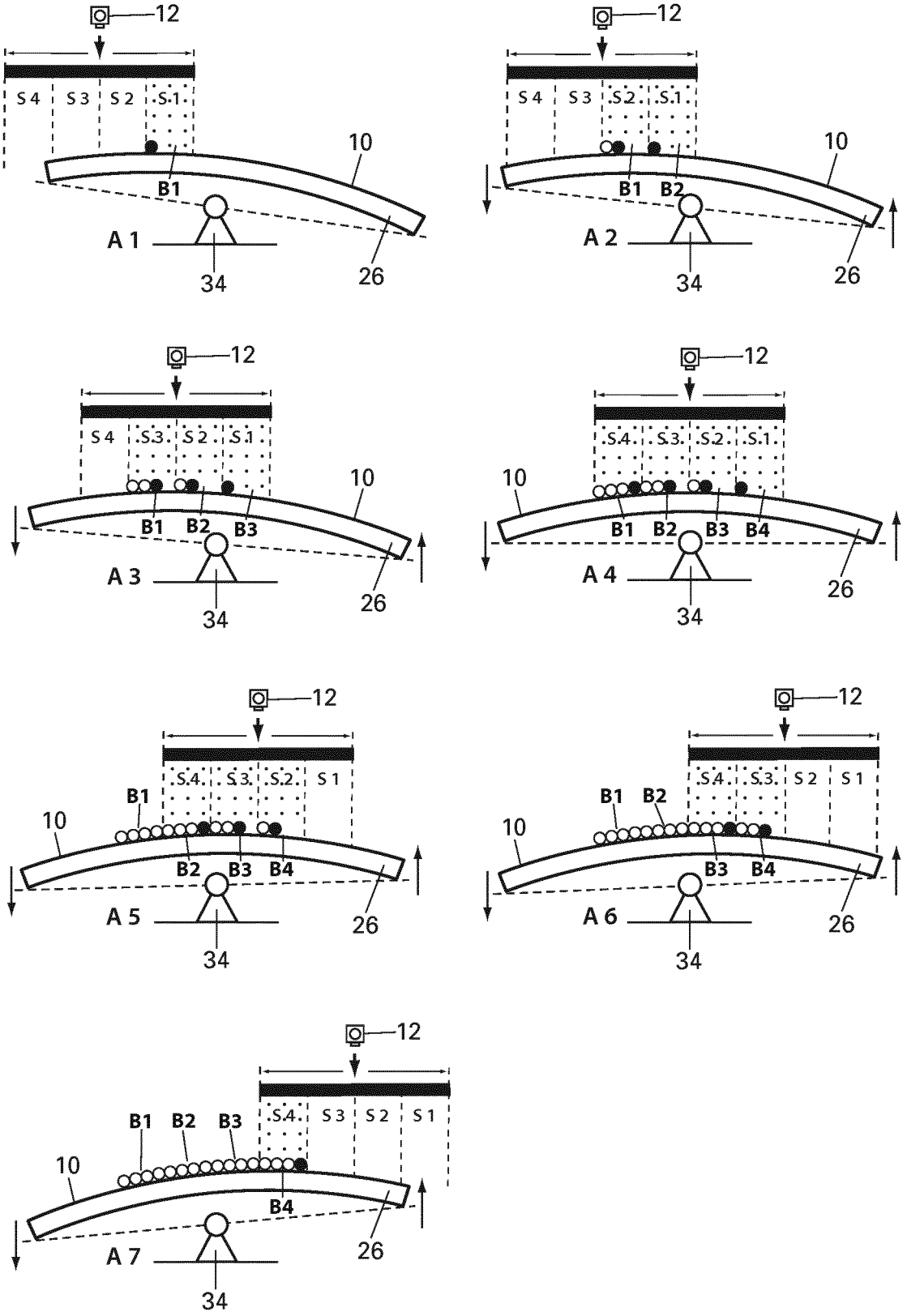
FIG. 9 shows views for explaining a further implementation mode of a method according to the present teachings.

A method is explained in the following with reference to FIG. 9, using which curved surfaces 10 in particular can be printed over a large surface with excellent quality. FIG. 9 shows the relative arrangement of a printhead 12 relative to a curved to-be-printed surface 10 during successive printing steps A1 to A7. The printhead 12 includes a discharge surface having sectors S1 to S4 disposed adjacent to one another in the drawing plane, which sectors S1 to S4 extend perpendicular to the drawing plane with a predetermined length and each have discharge openings. The printhead 12 is accommodated in a not-depicted mount, using which it is movable horizontally and vertically in the drawing plane. Using a mount 34, a component 26 provided with the to-be-printed surface 10 is tiltable about an axis extending perpendicular to the drawing plane and is movable perpendicular to the drawing plane.

In a first printing step A1, when the surface 10 moves relative to the printhead 12 perpendicular to the drawing plane, a first path B1 is printed by only activating discharge openings of the first sector S1. After the first printing step A1, the printhead 12 is moved perpendicular to the longitudinal extension of the first path B1 (perpendicular to the drawing plane in the transverse direction (i.e. horizontal in the drawing plane)) such that the second sector S2 is located over the first path B1. Subsequently, in a second printing step A2, the first path B1 is again printed from discharge openings of the second sector S2, and a second path B2, disposed adjacent to the first, is printed from discharge openings of the first sector S1.

The processes are repeated until, in printing step A4, a fourth path B4 is printed using discharge openings of the first sector S1, and the adjacent, already printed paths B1 to B3 are printed from discharge openings of the sectors S4 to S2, respectively.

In further printing steps A5 to A7, no additional paths are then printed; rather, after a lateral movement of the printhead 12 by the width of one sector, the number of the activated sectors, starting with sector S1, respectively decreases by one sector, so that after the last printing step A7 all paths B1 to B4 have been printed by all sectors S1 to S4.

As indicated in FIG. 9, the discharge openings of the individual sectors are electronically actuated such that they do not print the path each time with the entire droplet density; rather, a complete printing of the paths is only achieved in the last printing step, after which all paths have been printed by all of the sectors.

Between two printing steps, not only is a linear horizontal relative movement advantageously effected, but also a tilting of the surface 10 relative to the discharge surface 14 is effected such that the clearance between the surface 10 and the discharge surface 14 remains approximately constant.

The relative movements between the printhead 12 and the component 26 can be adapted to the conditions given by the curvature of the surface 10.

If more than the four paths B1 to B4 depicted in FIG. 9 are to be printed, the printing step A4, in which all sectors S1 to S4 are activated, can be repeated each time after a movement of the printhead 12 perpendicular to the longitudinal extension of the paths by the width of one sector, and optionally after tilting of the component 26.

Overall it is achieved by the method according to FIG. 9 that a to-be-printed surface is printable homogeneously and with a precisely predetermined surface density after it has been completely swept by the printhead by using meander-shaped relative movement between it and the printhead, wherein a printing step takes place during each of the mutually parallel straight-line passes of the meander-shaped routes. In this way, homogeneous conductor paths or homogeneous conductive layers, such as, for example, OLED layers, also can be printed without any cross-sectional- or resistance change.

Using the method delineated with reference to FIG. 9, surfaces also can be printed that have two flat regions of different inclination that merge into each other in a linear curvature region.

Figure 10:
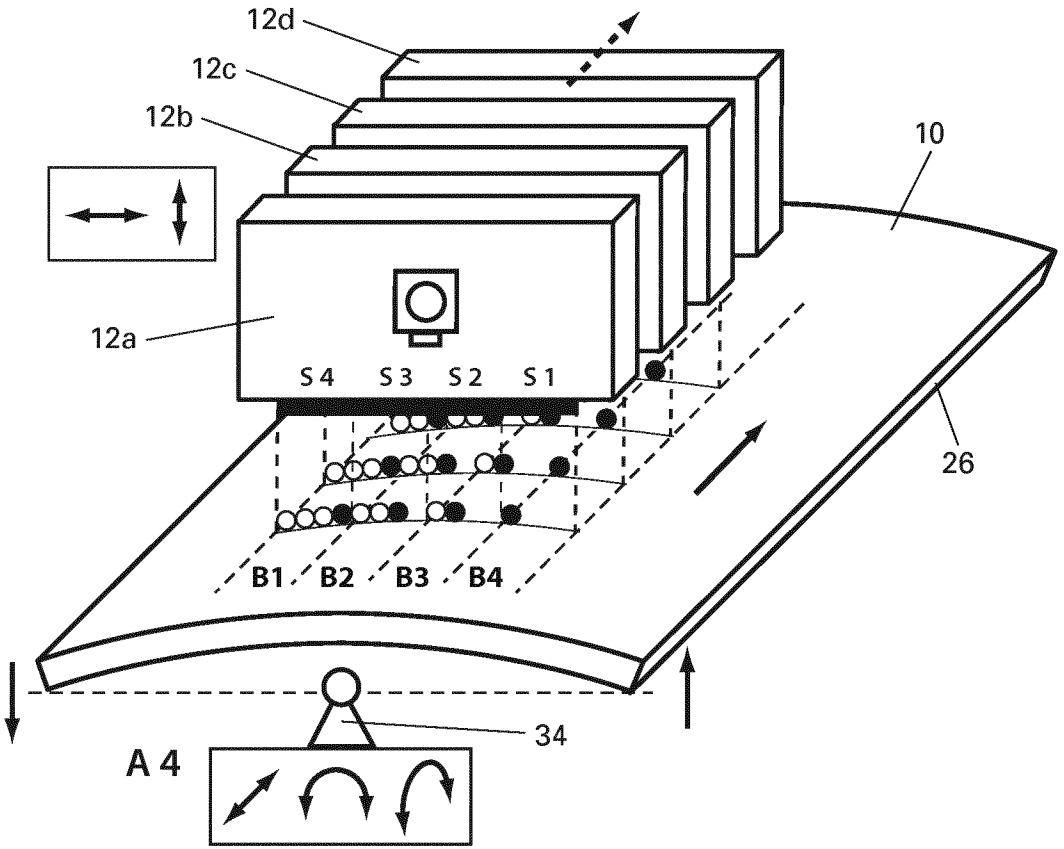
FIG. 10 shows a perspective view of a plurality of printheads and their arrangement relative to a to-be-printed surface.

FIG. 10 is a perspective illustration that shows a plurality of printheads 12*a*, 12*b*, 12*c*, 12*c*, 12*d* supported by a common mount (not depicted) and combined into a block, such that the printheads 12*a*, 12*b*, 12*c*, 12*d* are disposed one-behind-the-other in the longitudinal direction of the paths B1 to B4. Otherwise the arrangement corresponds to FIG. 9, wherein the system is in the state according to the printing step A4. Using the arrangement of FIG. 10, different liquids (vari-colored, electrically conductive, non-conductive, transparent etc.), for example, can be sprayed simultaneously from the individual printheads, so that the surface 10 can be printed with complex patterns and/or layers of constant thickness within a short time. The straight-line paths of the meander-shaped relative movement between the printheads and the surfaces to be printed are longer than the printed paths so that, similar to as in FIG. 9, at the start of a path, initially not all printheads (or not all sectors of one or more of the printheads) are activated or the printheads are activated in sequence, and at the end of a path all printheads are no longer activated or are deactivated in sequence.

As can be seen from the above, it is advantageous if a device, which allows a printing of three-dimensional surfaces, substantially free of limitations, using a digitally controlled printing method, permits a relative movement between the discharge surface 14 of the printhead 12 and the to-be-printed surface 10 or a component having this surface, both linearly in the three mutually perpendicular directions of the space and rotationally with three mutually perpendicular axes of rotation. It is substantially immaterial whether an electronically controlled mount of the component and/or an electronically controlled mount of the printhead allows these movabilities.

Figure 11:
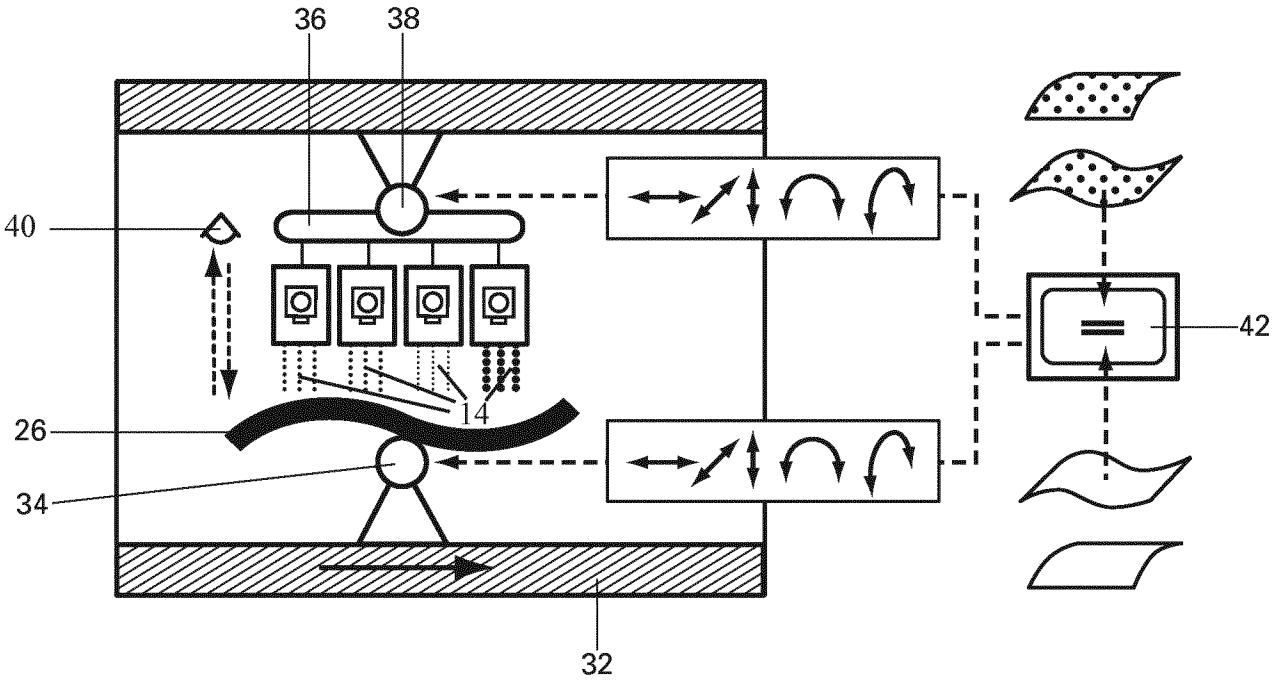
FIG. 11 shows a schematic view of a device for carrying out a method according to the present teachings.

A device or system for printing three-dimensional surfaces is schematically depicted in FIG. 11.

A mount 34 for supporting a component 26 having a to-be-printed surface 10 is movably attached to a frame 32. Using known drive devices, such as are used, for example, for CNC precision machine tools (not depicted), the mount 34, and with it the to-be-printed surface 10, is linearly movable in the three dimensions of the space and is rotatable about three mutually perpendicular axes.

A printhead 12 (e.g., of the design XAAR type 1003 or DIMATIX) assembled, in the example depicted, from a plurality of printing modules, which printhead 12 includes a flat discharge surface 14, in which individually actuatable discharge openings or nozzles are disposed, is attached to a mount 38 together with a liquid supply 36. Similarly to the mount 34, the mount 38, and with it the discharge surface 14 of the printhead 12, is linearly movable in the three dimensions of the space using known drive devices (not depicted) and is rotatable about three mutually perpendicular axes.

The liquid supply 36 can contain different liquid supplies, for example, normal printing inks, special inks, functional liquids having electrically conductive particles, coatings, primer, liquids for applying electrically insulating layers, etc.

A sensor device 40 is also attached to the mount 38, using which the clearance (spacing) between the discharge surface 14 and the to-be-printed surface 10 is determinable, and/or using which an optical property of to-be-printed or already-printed surface is detectable.

Geometric data of the to-be-printed surface 10, for example, CAD data and decor data, that contain the printings to be applied to the surface 10 with the liquid data required therefor are storable in an electronic control device 42 of a known design. Programs contained in the control device transform the geometric data of the surface 10 and the decor data into control data for controlling the movements of the mounts 34, 38, the supplying of liquids to the printhead 12, as well as the selection and the actuation of the discharge openings. Values determined by the sensor device 40 can be used to rapidly set target positions or to determine actual positions and printing states of the surface 10.

For example, the mount 38 for the printhead 12 is advantageously movable or drivable in the Z-direction (the clearance between the printhead and the to-be-printed surface 10) and in the Y-direction (the lateral offset of the printing paths). The mount 34 for the component 26 to be printed is advantageously drivable linearly in the X-direction (the longitudinal direction of a printing path B1, B2) and is rotatably drivable about the X-axis and the Y-axis.

It is explicitly emphasized that all of the features disclosed in the description and/or the claims should be considered as separate and independent from one another for the purpose of the original disclosure as well as for the purpose of limiting the claimed invention, independent of the combinations of features in the embodiments and/or the claims. It is explicitly stated that all range specifications or specifications of groups of units disclose every possible intermediate value or subgroup of units for the purpose of the original disclosure as well as for the purpose of limiting the claimed invention, in particular also as the limit of a range specification.

REFERENCE NUMBER LIST

10 Surface
12 Printhead
14 Discharge surface
16 Discharge openings
18 Clearance sensor
20 Computer
22 Sphere
24 Segment
26 Component
30 Overlap region
32 Frame
34 Mount
36 Liquid supply
38 Mount
40 Sensor device
42 Electronic control system
A Width of the printhead
A1, A2 Printing steps
B1, B2 Paths
B Minimum flight distance
C Maximum flight distance
M1 Curvature axis
X Permissible printing width
Z Cylinder axis Additional, non-limiting aspects and embodiments of the present teachings are described in the following:

1. A method for printing a surface (10) using a digital printing method, in which defined liquid quantities that impinge on the surface (10) as liquid droplets are sprayed from a plurality of individually actuatable discharge openings (16) disposed on an discharge surface (14) of a printhead (12), in which method, depending on the disposition of the discharge surface (14) relative to the surface (10) and the shape of the surface (10), only those discharge openings (16) are driven whose clearance (spacing) from the impingement point of the liquid droplet dispensed therefrom is within a predetermined value range.

2. The method according to the above Aspect 1, wherein the discharge surface (14) is flat, the surface (10) is curved, and the liquid droplets impinge on the surface (10) in a direction perpendicular to the discharge surface (14), in which method the surface (10) and the discharge surface (14) are oriented with respect to each other such that the discharge surface (14) is approximately parallel to a surface region, and the clearance between the surface region and the discharge surface (14) is within the predetermined value range.

3. The method according to the above Aspect 2, wherein the clearance for a convexly curved surface (10) is in the range of the minimum of the value range.

4. The method according to the above Aspect 2, wherein the clearance for a concavely curved surface (10) is in the range of the maximum of the value range.

5. The method according to any one of the above Aspects 2 to 4, wherein the liquid quantity that is applied by the liquid droplets to a surface unit of the surface increases with increasing angle between a respective surface unit and the discharge surface (14) such that the liquid quantity applied to the surface unit is constant independent of the angle.

6. The method according to any one of the above Aspects 2 to 5, wherein only those discharge openings (16) are activated whose liquid droplets impinge on the surface (10) at an angle of incidence greater than 78 degrees for a coating and greater than 84 degrees for a decor printing.

7. The method according to any one of the above Aspects 1 to 6, wherein during printing of a surface (10) having two mutually perpendicular axes of curvature and different radii of curvature, a relative movement takes place between the printhead (12) and the surface (10) to be printed in the circumferential direction of the curvature having the smaller radius of curvature during a first printing process; subsequently with non-activated discharge openings (16) a relative movement between the printhead (12) and the to-be-printed surface (10) takes place in the circumferential direction of the curvature having the larger radius of curvature, and subsequent thereto a relative movement between the printhead (12) and the to-be-printed surface (10) takes place in the circumferential direction of the curvature having the smaller radius of curvature during a further printing process, so that paths (B1, B2) formed during the printing processes are adjacent in the circumferential direction of the curvature having the larger radius of curvature.

8. The method according to any one of the above Aspects 1 to 7, wherein for a convex or concave curvature of the to-be-printed surface (10) and their printing in the form of adjacent paths (B1, B2), the positionings, viewed in the direction of the radius of curvature, of the discharge surface (14) with respect to the surface (10) during two successive relative movements between the surface (10) and the discharge surface (14) for forming the respective paths (B1, B2) are such that adjacent paths, within which the liquid can reach the surface, directly abut against each other.

9. The method according to any one of the above Aspects 1 to 7, wherein for a concave or convex curvature of the to-be-printed surface (10), the positionings, viewed in the direction of the axis of curvature, of the discharge surface (14) relative to the surface (10) during two successive relative movements between the surface (10) and the discharge surface (14) for forming a respective path (B1, B2) are such that adjacent paths, within which the liquid can reach the surface (10), overlap one another, and those discharge openings (16) of the discharge surface (14), from which the overlap region (30) is generated, are actuated such that the liquid quantities reaching a surface unit of the surface (10) are equal in the overlap region (30) and in the overlap-free regions of the paths (B1 and B2).

10. The method according to any one of the above Aspects 1 to 6, wherein the surface (10) is curved and printed with a plurality of paths (B1, . . . , Bn) that are directly adjacent perpendicular to their longitudinal extension, the discharge surface (14) includes a plurality of sectors (S1, . . . Bn) having discharge openings, which sectors are directly adjacent perpendicular to the longitudinal extension of the paths (B1, . . . Bn), in a first printing step (A1), a first path (B1) is printed only with the first sector (S1), after the first printing step, the printhead (12) is moved perpendicular to the longitudinal extension of the first path such that the second sector (S2) is located over the first path (B1), subsequently in a second printing step (A2), the first path (B1) is again printed with the second sector (S2), and a second path (B2) disposed adjacent to the first is printed with the first sector (S1), the processes are repeated until an m-th path (Bm) is printed with the first sector (S1), and the adjacent, already printed paths (Bm-1, . . . B1) are printed with sectors (S2, . . . , Sm), and in further printing steps, after a movement of the printhead (12) perpendicular to the longitudinal extension of the paths with each printing step by the width of a sector, the number of activated sectors, starting with the sectors S1 up to Sm, decreases, so that after the last printing step all paths of all sectors (S1 . . . Sm) are printed.

11. The method according to the above Aspect 10, wherein the printing step, in which all sectors (S1 . . . Sm) are activated, is repeated each time after a movement of the printhead (12) perpendicular to the longitudinal extension of the paths by the width of one sector.

12. The method according to the above Aspect 10 or 11, wherein, during a movement of the printhead (12) perpendicular to the longitudinal extension of the paths, each time by the width of one sector, a tilting of the surface (10) relative to the discharge surface (14) takes place each time such that the clearance between the surface (10) and the discharge surface (14) remains approximately constant.

13. A device for printing three-dimensional surfaces according to a method according to any one of the above Aspects 1 to 12, including:

a frame (32), a mount (34) for supporting a component (26) having a to-be-printed surface (10), a further mount (38) for supporting at least one printhead (12) having a discharge surface (14) that includes discharge openings (16) for spraying predetermined liquid quantities, a drive device, using which a relative movement between the discharge surface (14) and the to-be-printed surface (10) is drivable, a liquid supply (36) for selective supplying of the discharge openings (16) with printing liquid, and an electronic control device (42) having (storing) geometric data of the to-be-printed surface (10) and decor data that contain the printings to be applied to the surface (10) with the liquid data required therefor, and having (storing) programs that convert the geometric data of the surface (10) and the decor data into control data for controlling the drive device, for controlling the supplying of liquids to the printhead (12), and for selecting and actuating the discharge openings (16).

14. The device according to the above Aspect 13, wherein the mount (38) for the printhead (12) is movable in the Z-direction (the clearance between the printhead 12 and the to-be-printed surface 10) and in the Y-direction (the width direction of a path B1, B2), and the mount (34) for the to-be-printed component (26) is movable in the X-direction (the longitudinal direction of a path B1, B2) and is rotatable about the X-axis (the longitudinal direction of a path B1, B2) and the Y-axis.

15. The device according to the above Aspect 13 or 14, including a sensor device (40) for determining a clearance (spacing) between the discharge surface (14) and the to-be-printed surface (10) and/or for determining an optical property of the to-be-printed or already-printed surface.

The invention claimed is:

1. A method for printing at least one layer selected from a decorative layer, a functional layer having conductive regions, a uni-color layer or a uni-coating layer, which is transparent or non-transparent, and an adhesion-promotion layer on a to-be-printed surface comprising:

using a digital printing method to print the at least one layer by spraying defined liquid quantities that impinge on the to-be-printed surface as liquid droplets from a plurality of individually actuatable discharge openings disposed on a discharge surface of a printhead (12), wherein:

to print the at least one layer, depending on the disposition of the discharge surface relative to the surface and the shape of the surface, only those discharge openings that are spaced from respective points of impingement of the respective liquid droplets dispensed therefrom on the to-be-printed surface by distances that are between a minimum clearance (B) and a maximum clearance (C), are actuated to dispense the respective liquid quantities, the minimum clearance (B) is a minimum flight distance that each of the liquid quantities respectively requires to transform from respective liquid columns ejected from the actuated discharge openings into the respective liquid droplets, and the maximum clearance (C) exceeds the minimum clearance (B) by a predetermined distance (t), the maximum clearance (C) being a maximum flight distance before the respective liquid droplets degenerate and/or flight paths of the respective liquid droplets no longer extend in a straight-line manner.

2. The method according to claim 1, wherein the liquid quantities respectively applied to respective surface units of the to-be-printed surface as the liquid droplets increase with increasing angle between the respective surface unit and the discharge surface such that the liquid quantities respectively applied to the surface units remain constant independent of the angle.

3. The method according to claim 1, wherein all of the actuated discharge openings are oriented relative to the to-be-printed surface such that the respective liquid droplets impinge on the to-be-printed surface at an angle of incidence greater than 78 degrees for a coating and greater than 84 degrees for a decor printing.

4. The method according to claim 1, wherein:

the to-be-printed surface has both a first axis of curvature with a first radius of curvature and a second axis of curvature with a second radius of curvature, the first radius of curvature is smaller than the second radius of curvature and the first axis of curvature is perpendicular to the second axis of curvature, in a first printing step while a first subset of the discharge openings is being actuated to respectively dispense the defined liquid quantities, the printhead moves relative to the to-be-printed surface or vice versa in a circumferential direction of the first axis of curvature, subsequently, while the discharge openings are not being actuated, the printhead moves relative to the to-be-printed surface or vice versa in a circumferential direction of the second axis of curvature, and subsequent thereto, in a second printing step while a second subset of the discharge openings is being actuated to respectively dispense the defined liquid quantities, the printhead moves relative to the to-be-printed surface or vice versa in the circumferential direction of the first axis of curvature, so that printing paths formed during the first and second printing steps are adjacent in the circumferential direction of the second axis of curvature.

5. The method according to claim 1, wherein:

the to-be-printed surface is convex or concave, the printing step is performed by applying a plurality of adjacent printing paths, and as viewed in a direction of a radius of curvature of the convex or concave surface, the discharge surface is positioned with respect to the to-be-printed surface during two successive relative movements between the to-be-printed surface and the discharge surface for forming the respective printing paths such that adjacent ones of the printing paths, within which the liquid quantities can reach the to-be-printed surface, directly abut against each other.

6. The method according to claim 1, wherein:

the to-be-printed surface is convex or concave, as viewed in a direction of an axis of curvature, the discharge surface is positioned relative to the to-be-printed surface during two successive relative movements between the to-be-printed surface and the discharge surface for forming respective printing paths such that adjacent ones of the printing paths, within which the liquid quantities can reach the to-be-printed surface overlap one another, and an overlap printed region is generated by actuating a subset of the discharge openings such that the liquid quantities reaching respective surface units of the to-be-printed surface are equal in the overlap region and in overlap-free regions of the adjacent ones of the printing paths.

7. The method according to claim 1, wherein:

at least a portion of the surface is curved and is printed with a plurality of printing paths that are directly adjacent to each other in a direction perpendicular to a longitudinal extension of the plurality of printing paths, the discharge surface has a plurality of sectors each respectively having a plurality of the discharge openings, the sectors being directly adjacent to each other in the direction perpendicular to the longitudinal extension of the printing paths, in a first printing step (A1), a first one of the printing paths is printed by actuating only one or more of the discharge openings in the first sector, thereafter, the printhead is moved perpendicular to the longitudinal extension of the first one of the printing paths such that a second one of the sectors is located over the first one of the printing paths, subsequently in a second printing step (A2), the first one of the printing paths is again printed by actuating only one or more of the discharge openings in the second sector, and a second one of the printing paths that is disposed adjacent to the first one of the printing paths is printed by actuating only one or more of the discharge openings in the first sector, additional ones of the printing paths are printed until an m-th one of the printing paths is printed by actuating only one or more of the discharge openings in the first sector, and the adjacent, already printed ones of the printing paths are printed by actuating one or more of the discharge openings of the other ones of the sectors, and in further printing steps, the printhead is moved perpendicular to the longitudinal extension of the printing paths each time by the width of each one of the sectors prior to each printing step, and then the number of actuated sectors, starting with the first one of the sectors, decreases during each further printing step, so that when the last printing step has been completed all of the printing paths have been printed one time by each one of the sectors.

8. The method according to claim 7, wherein one of the printing steps, in which all sectors are concurrently being actuated, is repeated each time after the printhead has been moved perpendicular to the longitudinal extension of the paths by the width of one of the sectors.

9. The method according to claim 7, wherein while the printhead is being moved perpendicular to the longitudinal extension of the printing paths, each time by the width of one of the sectors, the to-be-printed surface is tilted relative to the discharge surface each time such that a clearance between the to-be-printed surface and the discharge surface remains approximately constant.

10. A printing device, including:

a frame, a first mount configured to support a component having a to-be-printed surface, a second mount configured to support at least one printhead having a discharge surface that includes discharge openings configured to spray predetermined liquid quantities, a drive device configured to move the discharge surface relative to the to-be-printed surface or vice versa, a liquid supply configured to selectively supply one or more printing liquids to the discharge openings, an electronic control device that stores:

geometric data concerning the to-be-printed surface and decor data that contain at least one printing design to be applied to the to-be-printed surface with printing liquid data required therefor, and programs that convert the geometric data of the to-be-printed surface and the decor data into control data for controlling the drive device, for controlling the supplying of liquids to the printhead, and for selecting and actuating the discharge openings in accordance with the method of claim 1.

11. The printing device according to claim 10, wherein:

the second mount is movable in a Z-direction and in a Y-direction, the first mount is movable in an X-direction and is rotatable about the X-axis and the Y-axis;

the X direction is a longitudinal direction of printing paths applied to the to-be-printed surface while the printhead moves relative to the to-be-printed surface or vice versa and the discharge openings are selectively actuated;

the Y direction is a width direction of the printing paths that is perpendicular to the longitudinal direction of the printing paths; and the Z direction is direction perpendicular to both the longitudinal direction and the width direction of the printing paths that defines a spacing between the printhead and the to-be-printed surface while the printhead moves relative to the to-be-printed surface or vice versa and the discharge openings are selectively actuated.

12. The printing device according to claim 11, including a sensor configured to determine an amount of the spacing between the discharge surface and the to-be-printed surface and/or to determine an optical property of the to-be-printed or an already-printed surface.

13. The method according to claim 1, wherein:

the to-be-printed surface includes a curved surface that is curved in three dimensions, the discharge surface is planar, during the printing step, the curved surface and the discharge surface are oriented with respect to each other such that a tangent of the curved surface is parallel to the planar discharge surface, if the curved surface is convex, said tangent of the curved surface is spaced from the discharge surface by the minimum clearance (B) or more, if the curved surface is concave, said tangent of the curved surface is spaced from the discharge surface by the maximum clearance (C) or less, and during a relative movement between the discharge surface and the to-be-printed surface perpendicular to the curvature of the to-be-printed surface, the to-be-printed surface is printed with a printing path having a printing width (X) determined as follows:

if the curved surface is convex, the printing width (X) is set by two discharge openings of the subset of actuated discharge openings that are located at opposite ends of a row of the discharge openings and are spaced apart from the to-be-printed surface by the maximum clearance (C), and if the curved surface is concave, the printing width (X) is set by two discharge openings that are located at opposite ends of the row of discharge openings and are spaced apart from the to-be-printed surface by the minimum clearance (B).

14. The method according to claim 13, wherein:

the printing width (X) of the path is approximately equal to $2\times(t\times r)^{0.5}$ when t is small in comparison to r, and r is the radius of curvature of the curved surface.

15. The method according to claim 1, wherein the digital printing method is inkjet printing.

16. The method according to claim 1, wherein:

the to-be-printed surface includes a curved surface that is curved in three dimensions, the discharge surface of the printhead is planar such that the discharge openings are arranged in one plane, during the inkjet printing step, the curved surface and the discharge surface are oriented with respect to each other such that a tangent of the curved surface is parallel to the planar discharge surface, if the curved surface is convex, said tangent of the curved surface is spaced from the discharge surface by the minimum clearance (B) or more, but less than the maximum clearance (C), if the curved surface is concave, said tangent of the curved surface is spaced from the discharge surface by the maximum clearance (C) or less, but greater than the minimum clearance (B) and during a relative movement between the discharge surface and the to-be-printed surface perpendicular to the tangent of the to-be-printed surface, the discharge openings in the actuated subset eject the defined liquid quantities across a printing path having a printing width (X) determined as follows:

if the curved surface is convex, the printing width (X) is set by two discharge openings of the subset of actuated discharge openings that are: (i) located at opposite ends of a row of the discharge openings parallel to the tangent and (ii) spaced apart from the to-be-printed surface by the maximum clearance (C), and if the curved surface is concave, the printing width (X) is set by two discharge openings that are: (i) located at opposite ends of the row of discharge openings parallel to the tangent and (ii) spaced apart from the to-be-printed surface by the minimum clearance (B).

17. The method according to claim 16, wherein:

the printing width (X) is at least substantially equal to $2\times(t\times r)^{0.5}$, and r is the radius of curvature of the curved surface.

18. The method according to claim 17, wherein the actuated subset of the discharge openings are oriented relative to the to-be-printed surface such that the respective liquid droplets impinge on the to-be-printed surface at an angle of incidence greater than 84 degrees.

19. A printing method comprising:

inkjet printing at least one layer on a to-be-printed surface by actuating at least one individually actuatable discharge opening of a subset of a total number of individually actuatable discharge openings defined in a discharge surface of a printhead to eject defined quantities of one or more liquids that impinge on the to-be-printed surface at respective points of impingement, wherein:

the at least one layer is selected from a decorative layer, a functional layer having electrically conductive regions, a uni-color layer, a uni-coating layer, and an adhesion-promotion layer, all of the discharge openings in the subset are spaced from the respective points of impingement of the liquids on the to-be-printed surface between a minimum clearance (B) from the respective points of impingement and a maximum clearance (C) from the respective points of impingement, the minimum clearance (B) is a minimum flight distance that each of the defined liquid quantities respectively requires to transform from a liquid column ejected from the respective actuated discharge opening into a substantially spherical liquid droplet, and the maximum clearance (C) exceeds the minimum clearance (B) by a predetermined distance (t), the maximum clearance (C) being a maximum flight distance before the respective substantially spherical liquid droplets degenerate and/or flight paths of the respective substantially spherical liquid droplets begin to deviate from a straight line.

* * * * *